US005389906A

United States Patent [19]

Castonguay et al.

[11] Patent Number: 5,389,906

[45] Date of Patent: Feb. 14, 1995

[54] COST-EFFICIENT INDUSTRIAL-RATED MOLDED CASE BREAKER

[75] Inventors: Roger N. Castonguay, Terryville; David Arnold, Chester; Roger J. Morgan, Simsbury; Frederic W. Glabau, Kensington, all of Conn.; Henry J. Tucholski, Fremont Center, N.Y.; Thomas T. B. Reyes, Parque Jardines, Puerto Rico

[73] Assignee: General Electric, New York, N.Y.

[21] Appl. No.: 243,032

[22] Filed: May 16, 1994

Related U.S. Application Data

[62] Division of Ser. No. 109,871, Aug. 20, 1993, Pat. No. 5,337,031.

[51] Int. Cl.[6] ..... H01H 9/00

[52] U.S. Cl. ..... 335/172; 335/167

[58] Field of Search ..... 335/23, 24, 25, 167–176; 200/144 R, 147 R

[56] References Cited

U.S. PATENT DOCUMENTS 4,931,602 6/1990 Toda et al. ..... 335/13

4,951,020 8/1990 Changle et al. ..... 335/167

*Primary Examiner*—Lincoln Donovan

*Attorney, Agent, or Firm*—Richard A. Menelly

[57] ABSTRACT

A molded case circuit breaker controlled by an electronic trip unit is cost-competitive with electromagnetic circuit interruption devices. A novel contact arm assembly and shield arrangement in combination with a contact arm spacer and operating cradle interface reduces the assembly time and the number of operating components to effect significant cost savings.

1 Claim, 5 Drawing Sheets

COST-EFFICIENT INDUSTRIAL-RATED MOLDED CASE BREAKER

This is a Divisional of application Ser. No. 08/109,871, filed Aug. 20, 1993, is now U.S. Pat. No. 5,337,031.

BACKGROUND OF THE INVENTION

U.S. Pat. No. 5,027,092 entitled "Tripping Arrangement for Molded Case Circuit Interrupter" describes an operating mechanism that is controlled by an electronic trip unit. The trip actuator unit interfacing between the electronic trip unit and the operating mechanism is described within U.S. Pat. No. 5,172,088 entitled "Molded Case Circuit Breaker Combined Accessory Actuator Reset Lever".

The use of an electronic trip unit within such circuit breakers in place of standard thermal-magnetic trip units allows for some savings by using rating plugs to provide a single circuit breaker housing over a wide range of electrical distribution circuit ampere ratings. U.S. Pat. No. 4,728,914 and the references contained therein describe the function of the rating plug in circuit with the electronic trip unit to set the ampere rating. The use of electronic trip units has also been found to contribute to the overall cost of the circuit breaker since current transformers are required to sample the circuit current and input the current to the electronic trip unit for evaluation. It would be economically advantageous to provide a circuit breaker having the facility of electronic trip units and being economically comparable with earlier circuit breakers employing less expensive thermal-magnetic trip units.

One purpose of the invention is to provide a circuit breaker operating mechanism and contact arm assembly requiring less components than similar state-of-the-art designs resulting in a substantial savings in the cost of the components and the cost of their assembly.

SUMMARY OF THE INVENTION

The invention comprises a molded case circuit breaker controlled by an electronic trip unit that is cost-competitive with those circuit breakers employing a thermal-magnetic trip unit. A contact arm assembly requiring a minimum number of operating components and reduced assembly time is employed. The main movable contact arms are formed from a high speed punch and die to eliminate machining. A locating bracket is used to space and align the main and arcing movable contact arms as well as to support the operating mechanism arc shield. A guide bracket arranged on the contact arm assembly aligns the movable arcing contact arm and provides a stop to the contact arm under short circuit interruption. A stream-lined operating cradle assembly is utilized along with the contact arm assembly.

DESCRIPTION OF THE PREFERRED EMBODIMENT

Figure 1:
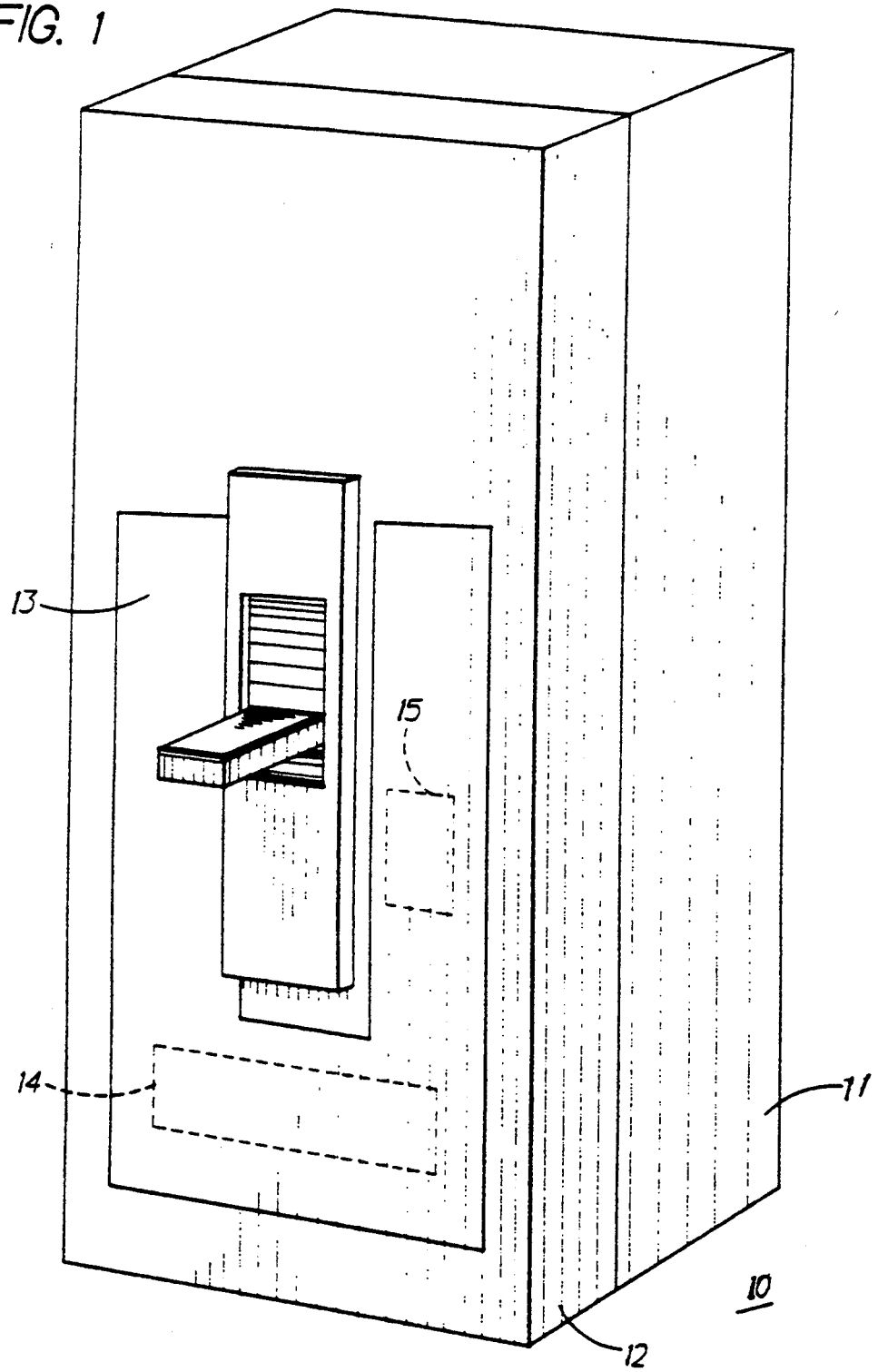
FIG. 1 is a front perspective view of a molded case circuit breaker enclosure containing the contact arm assembly according to the invention.

An industrial-rated circuit breaker 10 is shown in FIG. 1 in the form of a molded plastic cover 12 attached to a molded plastic case 11. An accessory cover 13 is attached to the circuit breaker cover and houses optional circuit breaker accessories (not shown) along with the circuit breaker electronic trip unit 14. As earlier described, a rating plug 15 is used to set the circuit breaker trip unit ampere rating.

Figure 2:
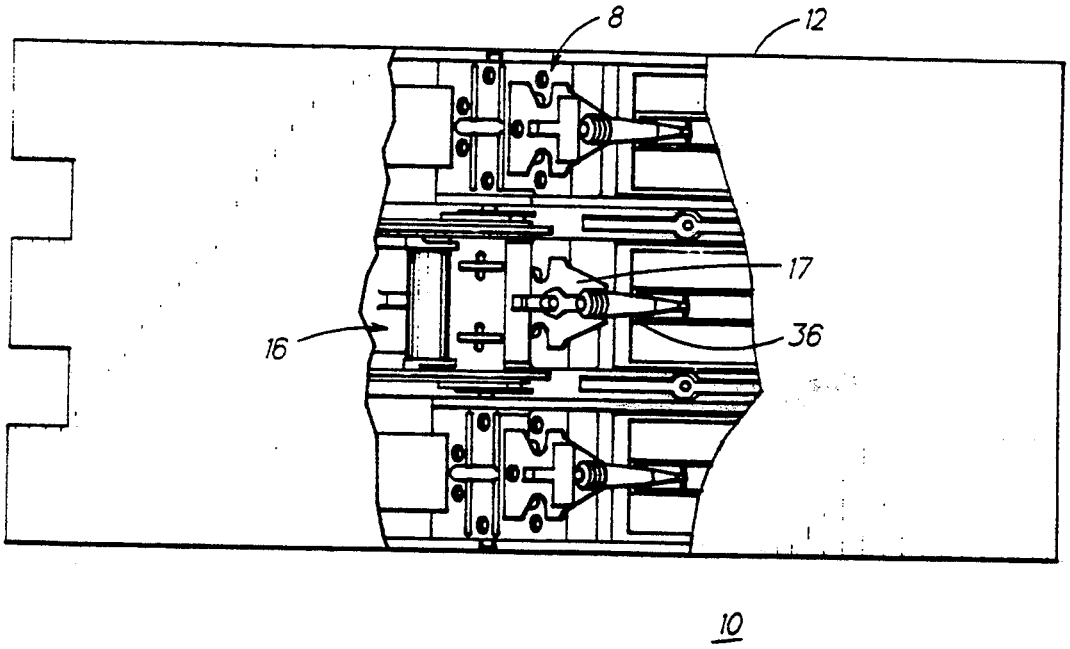
FIG. 2 is a top plan view of the circuit breaker of FIG. 1 with a part of the cover removed to depict the movable contact arm assembly.

The circuit breaker 10 is shown in FIG. 2 with the cover 12 partially removed to show the circuit breaker operating mechanism generally depicted at 16 which interacts with the movable contact arm assembly 8 to move the movable contact arm carrier 17 and attached arcing movable contact arm 18 to interrupt circuit current.

Figure 3:
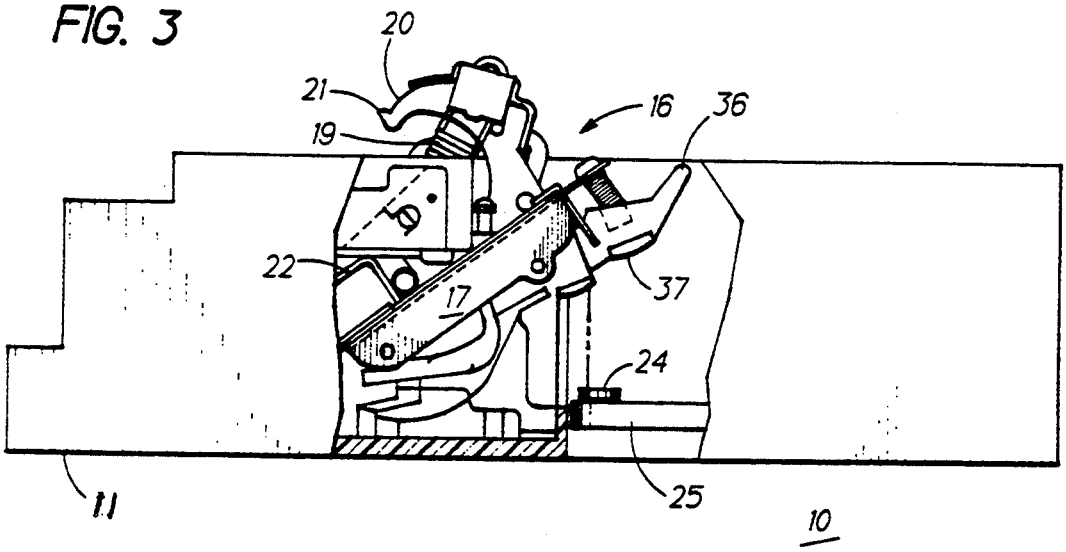
FIG. 3 is a cut-away side view of the circuit breaker of FIG. 1 depicting the movable contact arm assembly of FIG. 2.

The circuit breaker 10 is depicted in FIG. 3 with the case 11 partially removed to show the operating cradle 20 and the cradle hook 21 which retains the movable contact arm carrier 17 and attached arcing movable contact arm 18 against the bias exerted on all the movable contact arms by means of the powerful operating springs 19 within the operating mechanism 16. The arcing movable contact arm 18 is shown in the OPEN position with the attached arcing movable contact 23 out of electric circuit with the stationary contact 24 attached to the stationary contact support 25. The crossbar 22 within the operating mechanism 16 ensures that the arcing and main movable contact arms within the separate circuit breaker poles open simultaneously to prevent adverse "single phasing".

Figure 4:
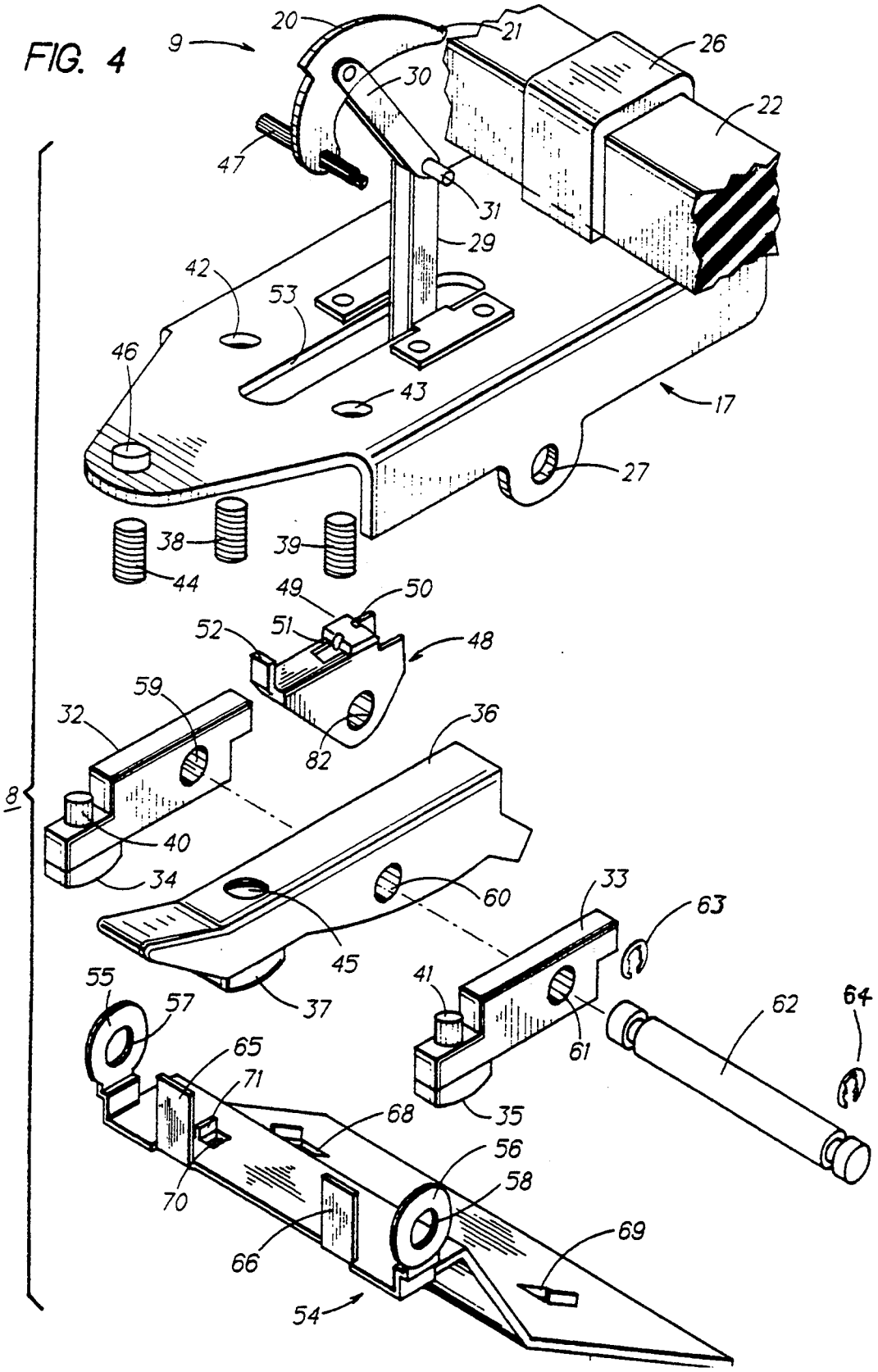
FIG. 4 is an enlarged top perspective view of the components within the movable contact arm assembly of FIG. 2.

The movable contact arm assembly 8 is shown in FIG. 4 prior to attaching the individual components. The movable contact arm carrier 17 is attached to the crossbar 22 by means of the staple 26 and the cradle assembly 9 is connected to the contact arm carrier by means of the link 30, pivot pin 31 and cradle support bracket 29. As earlier described, the cradle 20 includes a cradle hook 21 formed at one end. The cradle pivot pin 47 is attached to the opposite end in the manner to be described below in greater detail. Included within the movable contact arm assembly are the two main contact arms 32,33 with the attached main contacts 34,35. The arcing movable contact arm 18 with the attached arcing movable contact 23 is arranged intermediate the two arcing movable contact arms and are separated therefrom in the manner to be described below.

The main movable contact arm springs 38,39 are positioned over posts 40, 41 upstanding from the ends of the main movable contact arms 32,33 and are received at their opposite ends within corresponding openings 42,43 within the bottom surface of the movable contact arm carrier 17. The arcing movable contact arm spring 44 is trapped between the opening 45 on the top of the arcing movable contact arm 18 and the opening 46 formed on the movable contact arm carrier 17. The springs 38, 39, 44 provide pressure on the arcing and main movable contact arms and forces the attached arcing and main movable contacts into tight abutment with each of the associated stationary contacts (not shown). The guide bracket 48 is positioned on the arcing movable contact arm 18 such that the upstanding guide tab 52 extends within the elongated slot 53 formed within the movable contact arm carrier 17. The arcing movable contact arm stop 49 is attached to the top of the guide bracket 48 by means of a pair of tabs 50, 51 lanced from the top of the guide bracket 48.

A locating bracket 54 includes opposing sidearms 55, 56 within which a pair of openings 57, 58 are formed. The large tabs 65, 66 upstanding from the guide bracket separate, align and position the main movable contact arms 32, 33 in the manner to be described below. The smaller tabs 68, 69, 70 attach the operating mechanism arc gas shield 67, which is fabricated from a high temperature fiber or similar high temperature resistant material, to the bottom of the guide bracket.

Figure 5:
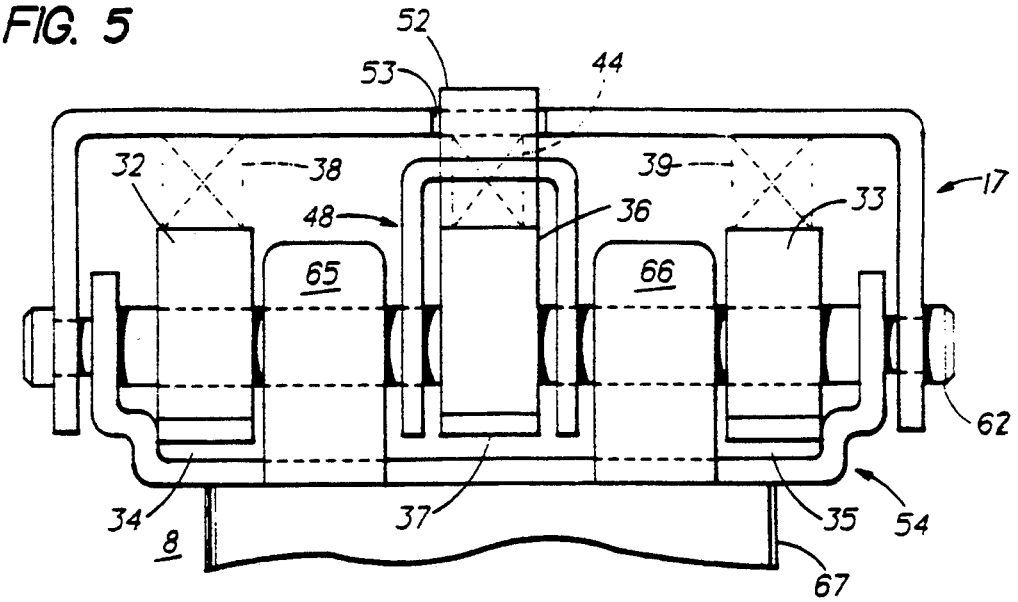
FIG. 5 is an enlarged end view of a part of the movable contact arm assembly of FIG. 2.

The movable contact arm assembly 8 is shown in FIG. 5 with the main movable contact arms 32, 33 carrying the associated main movable contacts 34, 35 attached to the movable contact arm carrier 17 by means of the retainer pin 62. The locating bracket 54 positions the large spacer tabs 65, 66 intermediate the main movable contact arms 32, 33 and the arcing movable contact arm 18 carrying the movable arcing contact 23. The operating mechanism arc shield 67 is shown depending downward from the bottom of the locating bracket to shield the operating mechanism and movable contact arm assembly components from debris and gases generated within the circuit breaker case during intense overcurrent circuit interruption. The main movable contact arm springs 38, 39 and the arcing movable contact arm spring 44 are shown trapped between the movable contact arm carrier as described earlier. The guide bracket 48 positioned on the arcing movable contact arm 36 helps to stabilize and control the movement of the arcing movable contact arm by the capture of the guide tab 52 on the top of the guide bracket within the elongated slot 53 formed within the movable contact arm carrier 17.

Figure 6:
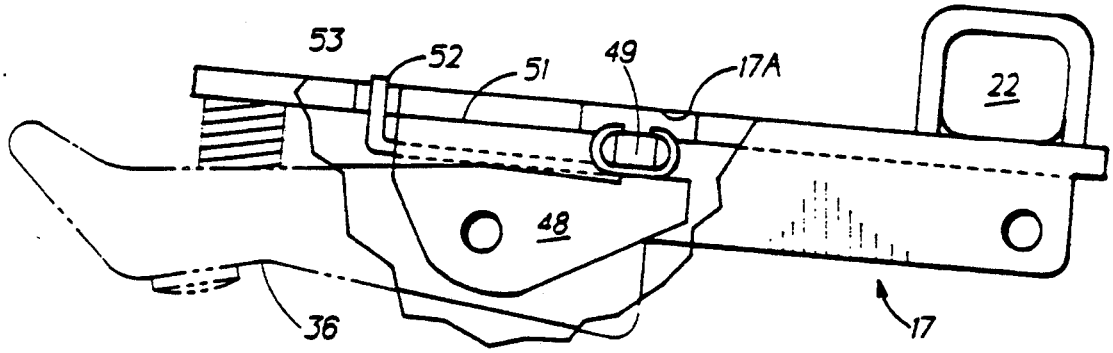
FIG. 6 is an enlarged side view of a part of the movable contact arm assembly of FIG. 2.

The location of the stop plate 49 which is attached to the top of the guide bracket 48 is best seen by referring to the movable contact arm carrier 17 shown attached to the crossbar 22 in FIG. 6. The stop plate 51 interacts with the bottom surface 17A of the movable contact arm carrier 17 to stop the motion of the arcing movable contact arm 18, shown in phantom, when the arcing movable contact arm is blown to an open position under intense overcurrent conditions. The large guide tab 52 on the top of the guide bracket 48 extends within the elongated slot formed within the movable contact arm carrier 17 to stabilize the arcing movable contact arm as earlier described with reference to FIG. 5.

Figure 7:
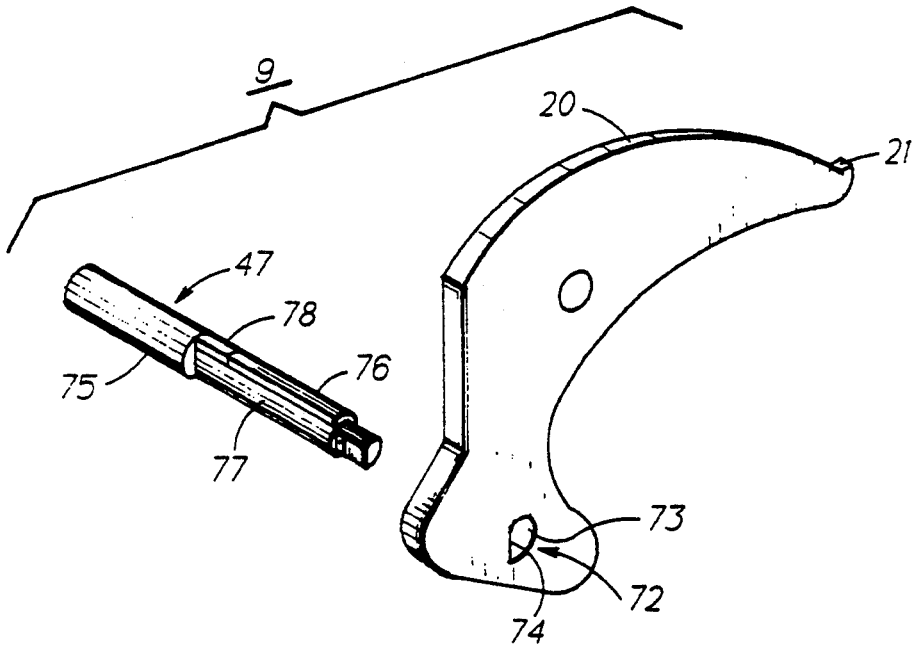
FIG. 7 is an enlarged top perspective view of the cradle assembly shown in FIG. 4.

An additional cost savings feature in the form of the cradle assembly 9 is shown in FIG. 7. To obviate the need for welding or brazing operations to attach the cradle pivot pin 47 to the operating cradle 20, one half of the cradle pivot pin has a combined circular and planar perimeter as indicated at 76, 77 respectively. The opposite half has a uniform circular perimeter as indicated at 75. The shaped opening 72 on the cradle 20 on the end of the cradle opposite from the hook 21 has a corresponding circular and planar configuration as depicted at 73, 74 respectively. The striations 78 formed on the cradle pivot pin fixedly attach the cradle pivot pin to the cradle when the half containing the circular and planar configuration is press-fit within the shaped opening and the striations cut into and "cold weld" to the interior of the shaped opening.

Figure 8:
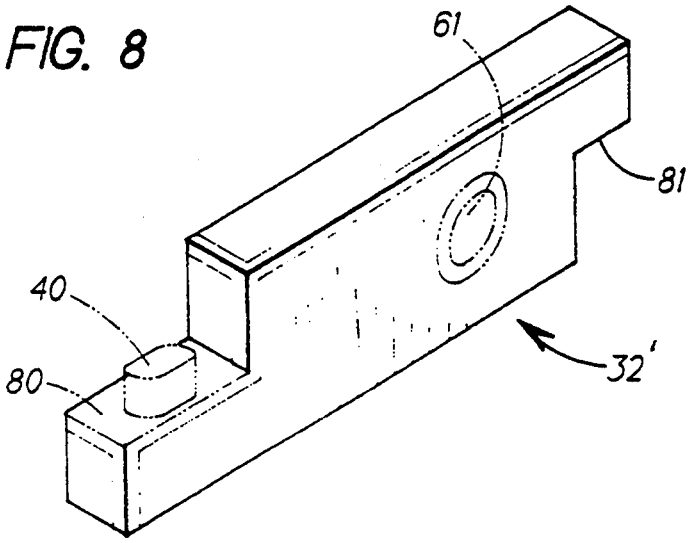
FIG. 8 is an enlarged side view of a contact arm blank used to form the movable contact arms of FIG. 2.

Additional cost savings are realized by using the main movable contact arm blank 32' shown in FIG. 8 to form the main movable contact arms 32, 33 as shown earlier in FIG. 4. The main movable contact arm blank is die-punched to automatically and simultaneously form the shaped end 80, spring retaining post 40 and the retainer pin opening 61, all as shown in phantom. The elimination of the costly machining operations to form the earlier main movable contact arms substantially reduces the overall production and material costs since two main movable contact arms are used within each pole of an industrial-rated circuit breaker.

We claim:

1. A movable contact arm carrier for molded case circuit breakers comprising:

a U-shaped support having a pair of downward depending sidearms integrally-formed from a first planar surface, said planar surface including an opening formed therein, said shaped opening defining an aperture having a circular perimeter on one part and a planar perimeter on the remainder thereof;

a cradle support bracket extending from a top of said planar surface and adapted for supporting an operating cradle;

a pair of main movable contact arms arranged between said sidearms and having a main movable contact fastened to one end;

an arcing movable contact arm intermediate main contact arms and having an arcing contact fastened to one end; and an operating cradle pivotally-arranged on said support bracket, said cradle including a hook at one end and a shaped opening at an opposite end;

a cradle pivot pin attached to said cradle, said cradle pivot pin having a uniform perimeter on one part and a non-uniform perimeter on another part thereof, aid non-uniform perimeter defining a circular perimeter on one part and a planar perimeter on the remainder thereof; and a plurality of striations on said non-uniform part, said striations fastening said cradle pivot pin to said cradle when said cradle pivot pin is inserted within said shaped opening in press-fit relation.

* * * * *